US005592909A

United States Patent [19]

Tsuruta

[11] Patent Number: 5,592,909

[45] Date of Patent: Jan. 14, 1997

[54] CAMSHAFT PHASE CHANGING DEVICE

[75] Inventor: Seiji Tsuruta, Atsugi, Japan

[73] Assignee: Unisia Jecs Corporation, Atsugi, Japan

[21] Appl. No.: 406,302

[22] Filed: Mar. 17, 1995

[30] Foreign Application Priority Data

Mar. 18, 1994 [JP] Japan ..... 6-048789

[51] Int. Cl.[6] ..... F01L 1/34

[52] U.S. Cl. ..... 123/90.17; 123/90.31; 74/508 R; 464/2

[58] Field of Search ..... 123/90.15, 90.17, 123/90.31; 74/567, 568 R; 464/1, 2, 160, 161

[56] References Cited

U.S. PATENT DOCUMENTS

| | | | |
|---|---|---|---|
| 4,811,698 | 3/1989 | Akasaka et al. | 123/90.17 |
| 5,033,327 | 7/1991 | Lichti et al. | 74/568 R |
| 5,088,456 | 2/1992 | Suga | 123/90.17 |
| 5,119,691 | 6/1992 | Lichti et al. | 74/568 R |
| 5,163,872 | 11/1992 | Niemiec et al. | 464/2 |
| 5,197,421 | 3/1993 | Hara | 123/90.17 |
| 5,203,290 | 4/1993 | Tsuruta et al. | 123/90.17 |
| 5,309,873 | 5/1994 | Suga et al. | 123/90.17 |

FOREIGN PATENT DOCUMENTS 6-28203 4/1994 Japan .

*Primary Examiner*—Weilun Lo
*Attorney, Agent, or Firm*—Foley & Lardner

[57] ABSTRACT

A variable camshaft phase changing device has an annular piston and lash take up front and rear gears with inner and outer helical spline for phase changing and a return spring for the piston. The annular piston is maintained in drive relation with the front and rear gears in such a manner as to relieve lash take-up friction on the piston stroke against the return spring and on the piston return stroke.

11 Claims, 6 Drawing Sheets

CAMSHAFT PHASE CHANGING DEVICE

BACKGROUND OF THE INVENTION

The present invention relates to a camshaft phase changing device and more particularly to a camshaft phase changing device for varying the timing of the valve actuation by an engine driven camshaft.

It is known in the art relating to engine valve gear to provide various means for varying valve timing as desired for the control of engine performance and efficiency. Among the various types of variable valve timing devices there have been employed camshaft phase changing devices, often in the form of drive pulleys or sprockets incorporating phase changing means for varying the phase between drive and driven members. Among the pertinent prior art, there are mechanisms having splined pistons that are hydraulically actuated against a return spring to vary the phasing of outwardly and inwardly engaged drive and driven members. Such arrangements are shown for example in U.S. Pat. Nos. 5,163,872 to Niemiec et al. and 5,119,691 to Lichti et al.

SUMMARY OF THE INVENTION

The present invention extends the concepts of the prior art to provide an especially effective form of phase changing device. In various embodiments, the invention is used as a variable camshaft phase changing device applied in an engine camshaft drive to vary the phase or timing of a driven camshaft relative to a drive member, such as a sprocket, that is driven in timed relation to an engine crankshaft or the like.

According to the present invention, there is provided a variable camshaft phase changing device for an internal combustion engine having a camshaft rotatable about a camshaft axis, comprising:

co-axial drive and driven members, said driven member being securable to the camshaft for rotation therewith about an axis;

a pair of axially-spaced annular gears disposed and engaged between said drive and driven members, said pair of axially-spaced annular gears having inner and outer splines;

means for biasing said annular gears one toward the other for lash take-up;

force means for axially moving said annular gears in one direction to vary the phase relationship between said drive and drive members, said force means including an annular piston, a chamber on one side of said annular piston and oil under pressure supplied to said chamber, said annular piston being axially movable in said one direction in response to said oil under pressure supplied to said chamber, said annular piston having a plurality of pins passing through one of said annular gears toward the other of said annular gears;

return spring means biasing said annular piston in a return direction opposite to said one direction to keep said pins in driving contact with the other of said annular gears to move said other of said annular gears in said return direction as said annular piston moves in said return direction, said pins having portions arranged to come into driving relation with said one of said annular gears for transmitting motion of said plurality of pins to said one of said annular gears to move said one of said annular gears in said one direction as said annular piston moves in said one direction.

A further feature of the invention is that the portions of the pins of the annular piston are maintained in resilient relation with one of the pair of axially-spaced inwardly-biased (i.e., toward one another) anti-backlash annular gears after the portions of the pins have come into driving relation with the one of the annular gears. This arrangement results in suppressing hammering noise and wear, which otherwise occur due to repeated strike of the one of the annular gears with the portions of the pins.

Another feature is that spring means is compressed between the one of the annular gears and annular piston to bias the one annular gear toward the other of the annular gear.

Still another feature is that buffer springs in the form of wave spring washers or disc springs are mounted on the one of the annular gears and arranged to contact with the mated portions of the pins, respectively.

DETAILED DESCRIPTION OF THE INVENTION

Figure 1:
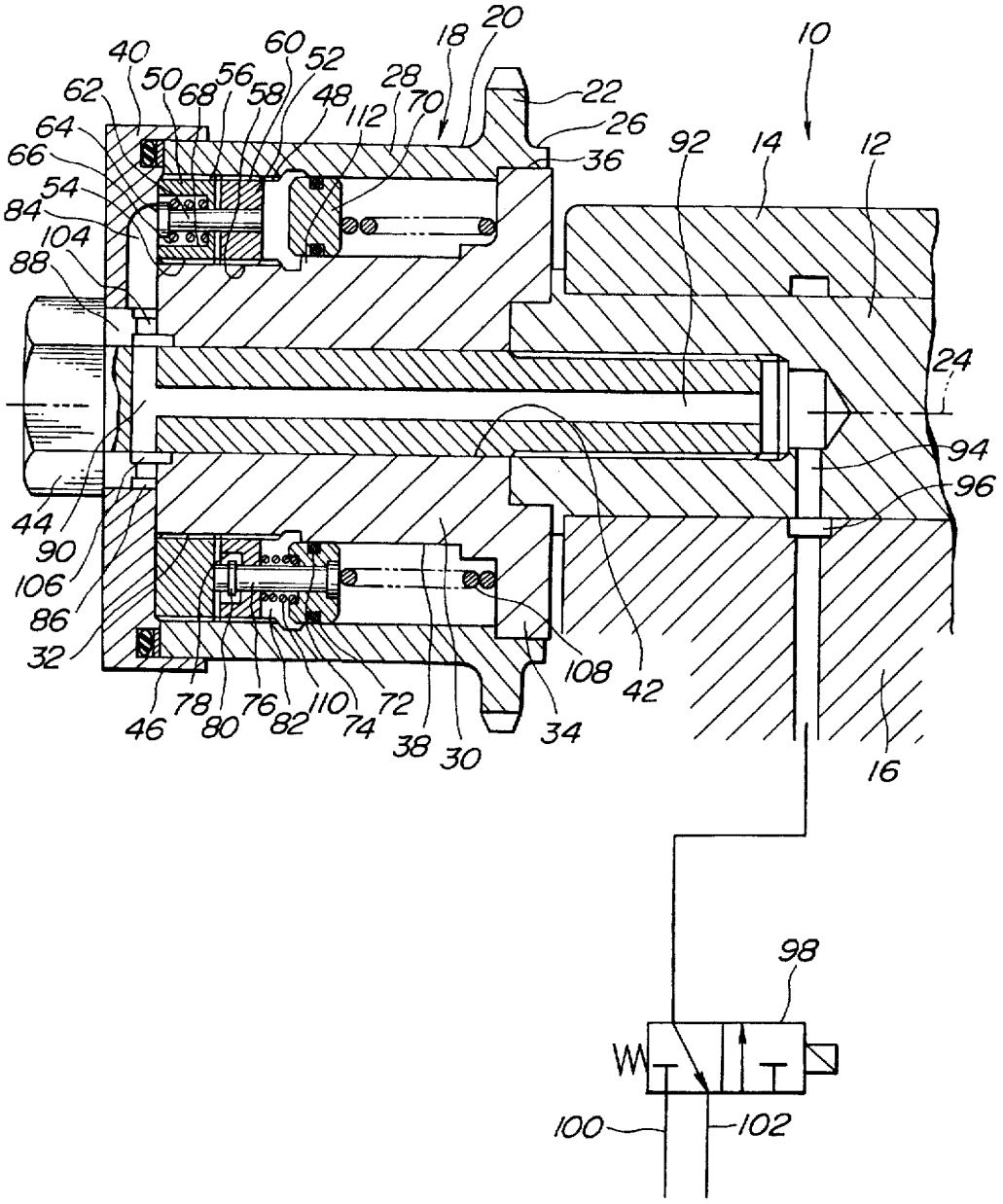
FIG. 1 is a cross-sectional view of a variable camshaft phase changing device in one extreme position with a solenoid control valve deenergized (i.e., off condition)

Referring to FIG. 1 of the drawings, in detail, numeral 10 generally indicates an internal combustion engine of a type having a camshaft 12 driven by a crankshaft, not shown. The camshaft 12 carries a plurality of cams (not shown) for actuating cylinder intake and/or exhaust valves (not shown) of the engine in known manner. It is supported in part by a front bearing 14 that is carried by an engine cylinder head 16.

On the front, driven, end of the camshaft 12, there is a variable camshaft phase changing device 18 that includes a sprocket 20. The sprocket 20 comprises a wheel 22 that is toothed and drivably engaged by a timing chain, not shown, for rotatably driving the sprocket 20 on an axis 24 that is co-axial with the camshaft 12. Within the wheel 22 is a rearwardly extending hub 26 and a forwardly extending hub 28.

The variable camshaft phase changing device 18 further includes a stub shaft in the form of a spline shaft 30 having an external helical spline 32 adjacent one or front end and a rear flange 34 at the other or rear end. The rear flange 34 has a finished journal 36 at its outer periphery. Between the external helical spline 32 and rear flange 34 is a finished cylindrical surface 38. The front end of the spline shaft 30 abuts on an inner face of a cover 40. The cover 40 and spline shaft 30 are secured through a central opening 42 to the front end of the camshaft 12 by a screw 44. Although not shown, a dowel pin is received in openings of the spline shaft 30 and camshaft 12 to maintain a fixed drive relation between the spline shaft 30 and camshaft 12.

The rearwardly extending hub 26 is carried for angular motion on the journal 36 of the rear flange 34. The forwardly extending hub 26 extends to the inner face of the cover 40 and is carried for angular motion on a cylindrical inner surface of a peripheral sleeve 46 of the cover 40.

The end of the spline shaft 30 formed with the external helical spline 32 and cylindrical surface 38 extends forwardly within the forwardly extending hub 28 concentric with the inner diameter thereof. The forwardly extending hub 28 has an internal helical spline 48 facing the external helical spline 32. The facing splines 32 and 48 have opposite helix angles to provide for the phasing action.

Between and engaging both splines 32 and 48 are two axially-spaced annular gears, called for convenience, a front or outer gear 50 and a rear or inner gear 52, the rear gear 52 being closer to the rear flange 34 of the spline shaft 30. Both gears 50 and 52 have inner and outer helical splines drivingly mated with the external and internal splines 32 and 48 of the spline shaft 30 and sprocket 20, respectively. Specifically, the front gear 50 has inner and outer helical splines 54 and 56, while the rear gear 52 has inner and outer helical splines 58 and 60.

The front and rear gears 50 and 52 are biased toward one another by a plurality of angularly spaced pins 62 press-fitted in the rear gear 52 and having heads 64 compressing coil springs 66 in recesses 68 on the far side or outside face of the front gear 50. The pins 62 extend through openings of the front gear 50. The openings are wide enough to allow the front gear 50 to move angularly relative to the rear gear 52. The splines of the front and rear gears 50, 52 are mis-aligned so that, when the front and rear gears 50 and 52 are urged toward one another, the splines of the front and rear gears 50 and 52 engage opposite sides of the mated splines 32 and 48 and thus take up the lash that would otherwise occur in transferring drive torque between the sprocket 20 and spline shaft 30.

An annular piston 70 carrying an outer peripheral seal 72 and an inner peripheral seal 74 is disposed adjacent the inside face of the rear gear 52 and mounted thereto by a plurality of angularly spaced pins 76. The pins 76 are secured to the annular piston 70 and extend forwardly through the rear gear 52 toward, for abutting against, the inside face of the front gear 50. Forward ends of the pins 76 are disposed within recesses 76 cut in the outside face of the rear gear 52. The pins 76 are slidably carried by the rear gear 52. Snap rings 80 within the recesses 78 are mounted around or encircle the pins 76, respectively, to limit axial and rearward displacement of the annular piston 70 away from the rear gear 52.

The annular piston 70 and seals 72, 74 together with the cylindrical surface 38 of the spline shaft 30 and the adjacent wall of the sprocket 20 define an annular chamber 82. Oil under pressure may be supplied to or discharged from this annular chamber 82 through an oil passage 84 in the cover 40 that leads to an outer annular groove 86 in an end collar 88 of the spline shaft 30, radial and axial passages 90 and 92 in the screw 44, and a radial passage 94 in the camshaft 12 that leads to an annular groove 96. The annular groove 96 is connected through schematically-illustrated passage means with a solenoid control valve 98, which operates to supply oil from an oil gallery 100 or to drain oil to a discharge line 102 while blocking the flow from the gallery 100. The outer annular groove 86 in the end collar 88 is connected through a plurality of openings 104 to an inner annular groove 106 connected to the radial passage 90 in the screw 44.

The annular piston 70 is urged in a direction compressing the annular chamber 82 by a coil return spring 108 that extends between the annular piston 70 and rear flange 34 of the spline shaft 30. The pins 76 are urged to abut on the inside face of the front gear 50, urging the front gear 50 against the cover 40. Mounted around or encircling the pins 76 are coil springs 110 compressed between the annular piston 70 and rear gear 52 to bias the rear gear 52 towards the snap rings 80 on the pins 76. The setting of the coil springs 110 is such that a total force of the coil springs 110 with which the coil springs 110 bias the rear gear 52 is less than a force of the coil return spring 108 with which the coil return spring 108 biases the annular piston 70.

In operation of the variable camshaft phase changing device 18 embodiment just described, when the solenoid valve 98 is not energized, called for convenience, off condition, the control valve 98 closes off the gallery 100 and opens the annular chamber 82 to the discharge line 102. The return spring 108 and coil springs 110 thus are able to maintain the annular piston 70, front and rear gears 50, 52 to their extreme forward or outer position near the cover 40 whereby the volume of the annular chamber 82 is held at a minimum. Specifically, the rear gear 52 is subject to a force of the springs 110, while the front gear 50 is subject to a force resulting from subtracting a force of the springs 66 from a sum of a force of the return spring 108 and a force of the springs 110. In this position, the camshaft 12 may be maintained by the front and rear gears 50, 52 in a retarded phase relation with the sprocket 20 for operation of the actuated intake engine valves under desired retarded timing conditions. In this position, if desired, the i camshaft 12 may be maintained in an advanced phase relation with the sprocket 20 for operation of the actuated exhaust engine valves under desired advanced timing conditions.

Figure 2:
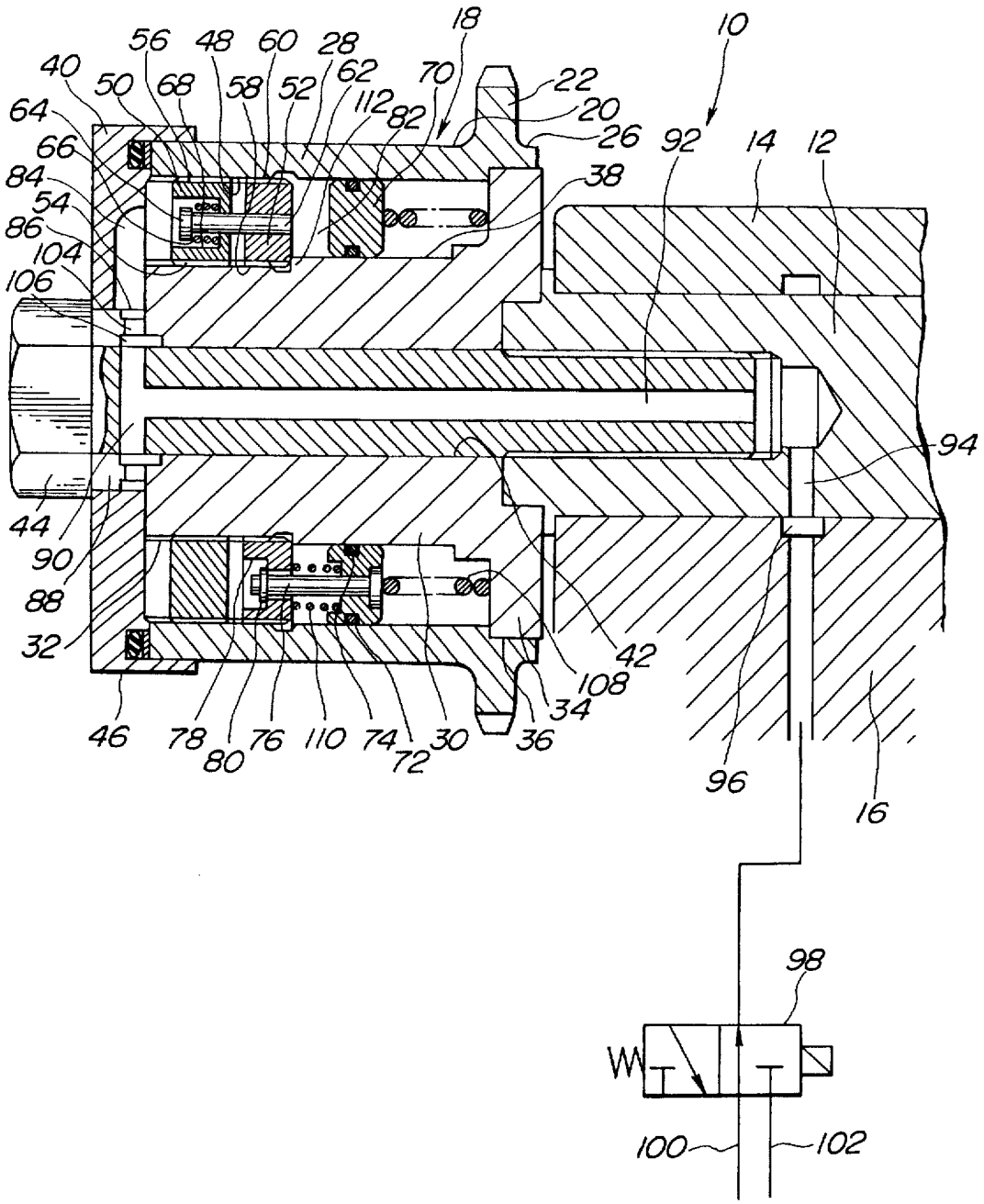
FIG. 2 is a cross-sectional view of the variable camshaft phase changing device of FIG. 1 in the extreme opposite position with the solenoid control valve energized (i.e., on condition)

When the engine operating conditions call for advanced valve timing of the intake engine valves or retarded valve timing of the exhaust engine valves, the solenoid valve 98 is energized to close off the discharge line 102 and to open the gallery 100 to supply oil under pressure to the annular chamber 82 in the variable camshaft phaser 18. The oil pressure moves the annular piston 70 against the bias of the return spring 108 to the extreme opposite position adjacent the rear flange 34, pulling the rear gear 52 after engagement of the snap rings 80 with the bottoms of the recesses 78 in the rear gear 52 and then pulling the front gear 50 that is biased toward the rear gear 52. During this movement, the coil springs 110 do not oppose to the oil pressure. FIG. 2 shows the extreme opposite position of the annular piston 70, front and rear gears 50, 52 when the solenoid 98 is energized, called for convenience, on condition. In this position, the rear gear 52 is pressed against an annular shoulder 112 defined between the external helical spline 32 and cylindrical surface 38 of the spline shaft 30. Thus, the front and rear gears 50, 52 can maintain the extreme opposite position as shown in FIG. 2 whenver the solenoid 98 is energized. Because of the opposite helix angles of the external and internal helical splines 32 and 48, the rearward or inward motion of the front and rear gears 50, 52 vary the phase angle of the camshaft 12 relative to the sprocket 20 so that the timing of the associated engine valves is likewise varied.

A return to the retarded timing of the intake valves or to the advanced timing of the exhaust valves when called for is accomplished by de-energizing the solenoid valve 98 blocking oil from the gallery 100 and allowing the annular chamber 82 in the variable camshaft phase changing device 18 to drain to the discharge line 102. The pins 76 extending from the annular piston 70 abut on the front gear 50, pushing the front gear 50 with a force resulting from subtracting a force of the springs 110 from a force of the return spring 108 until the front and rear gear 50, 52 and annular piston 70 are returned to their initial position adjacent the cover 40 (see FIG. 1).

In addition to their phase-changing function, the front and rear gears 50, 52 are also means through which all torque is transferred from the sprocket 20 to the camshaft 12 and vice versa via their inner and outer splines 54, 58 and 56, 60 and the mating external and internal helical splines 32, 48. The annular piston 70 does not constitute the means for transferring the torque. The mis-alignment of the front and rear gears 50, 52 and their biasing toward one another by the pins 62 and springs 66 takes up any clearance lash in the spline connections by urging the front and rear gears 50, 52 into engagement with opposite sides of the engaged splines 32, 48 as was previously described.

The passing of the pins 76 through openings, not numbered, in the rear gear 52, to extend into abutting engagement with the front gear 50 has a benefit. During the return stroke from on condition (see FIG. 2) to off condition (see FIG. 1), the pulling of the rear gear 52 behind the front gear 50 as it is moved by the return spring 108 tends to increase slightly the separation of the front and rear gears 50, 52 from one another and thereby reduce the lash take-up force, thus reducing the friction that opposes the return motion of the front and rear gears 50, 52. The required force for the return stroke may thereby be reduced.

The snap rings 80 on the pins 76 are out of engagement with the bottom of the recesses 78 in the rear gear 52 during the return stroke, but they establish a drive connection from the pins 76 to the rear gear 52 during the stroke from off condition (see FIG. 1) to on condition (See FIG. 2). During this stroke from off condition to on condition, the pulling of the front gear 50 behind the rear gear 52 as it is moved by the annular piston 70 tends to increase slightly the separation of the front and rear gears 50, 52 from one another and thereby reduce the lash take-up force, thus reducing the friction that opposes the rearward motion of the front and rear gears 50, 52. The required force by the oil pressure may thereby be reduced.

The coil springs 110 resiliently maintain the snap rings 80 in engagement with the rear gear 52 during the stroke from off condition (see FIG. 1) to on condition and at the on condition (see FIG. 2), while the snap rings 80 are out of engagement with the rear gear 52 during return stroke from the on condition to the off condition and at the off condition. The front and rear gears 50, 52 are urged to separate from one after another in transferring torque from the sprocket 20 to the camshaft 12 and vice versa. The force separating the rear gears 52 from the front gear 50 is opposed by the coil springs 110 during the stroke to on condition and at on condition, thus suppressing hammering noise and wear due to repeated strike of the rear gear 52 with the snap rings 80.

The coil springs 110 compressed between the rear gear 52 and annular piston 70 assist the action of return spring 108 in maintaining the rear gear 52 and front gear in their limit position shown in FIG. 1, and they do not oppose to the oil pressure acting on the annular piston 70. The bias of the return spring 108 may be reduced. Thus, the required force derived from the oil pressure for moving the annular piston 70 against the return spring 108 may thereby be reduced.

Figure 3:
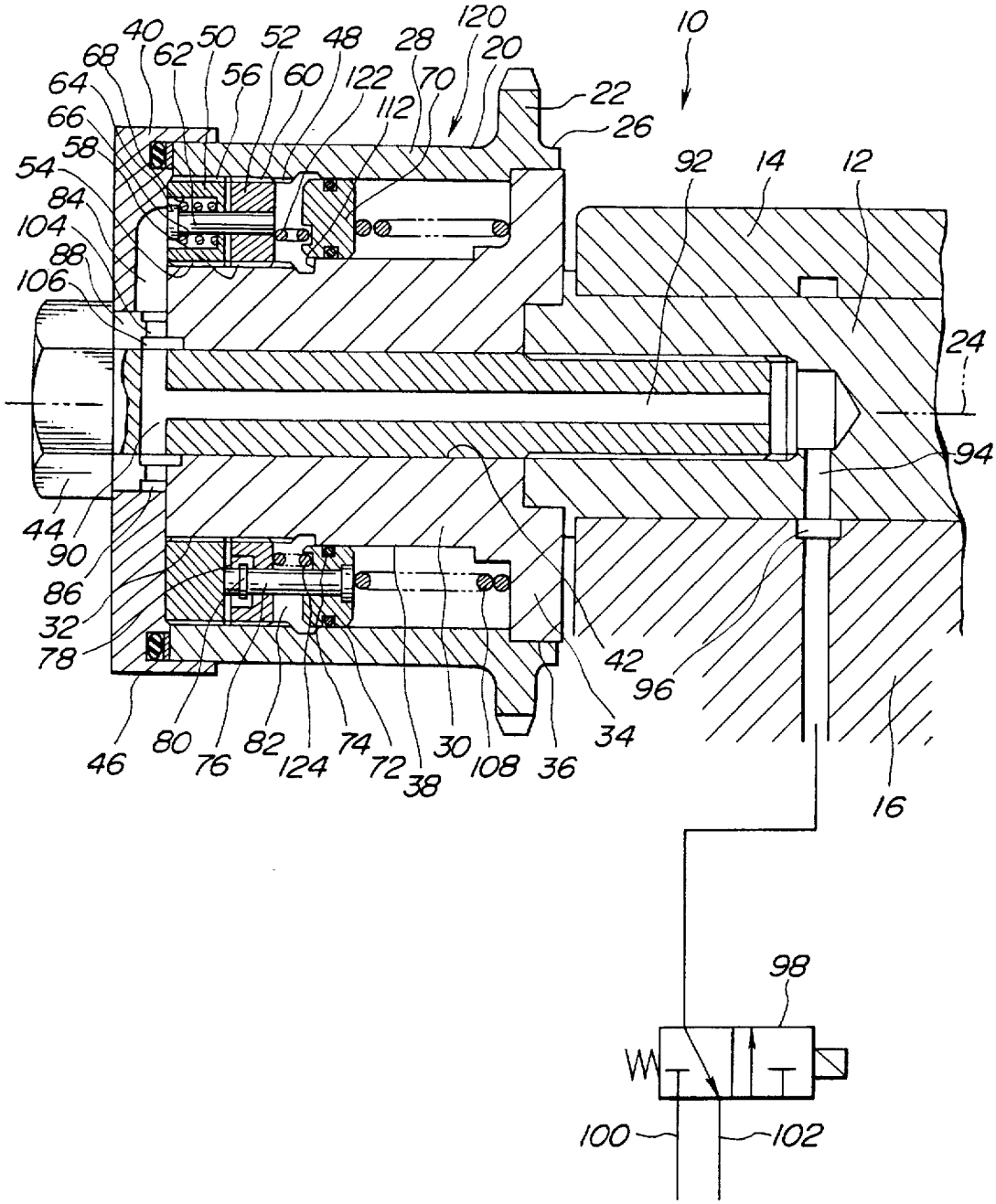
FIG. 3 is a similar view to FIG. 1 showing a second embodiment of varaible camshaft phase changing device.

FIG. 3 shows a second embodiment of variable camshaft phase changing device 120. This variable camshaft phase changing device 120 is substantially the same as the previously described variable camshaft phase changing device 18 except the provision of a single coil spring 122 instead of the plurality of coil springs 110 encircling the pins 76. As shown in FIG. 3, the single coil spring 122 is compressed between a rear gear 52 and an annular piston 70. One end of the coil spring 122 is received in an annular recess 124 in the annular piston 70 and disposed radially inwardly relative to the camshaft axis compared to pins 76 of the annular piston 70.

Figure 4:
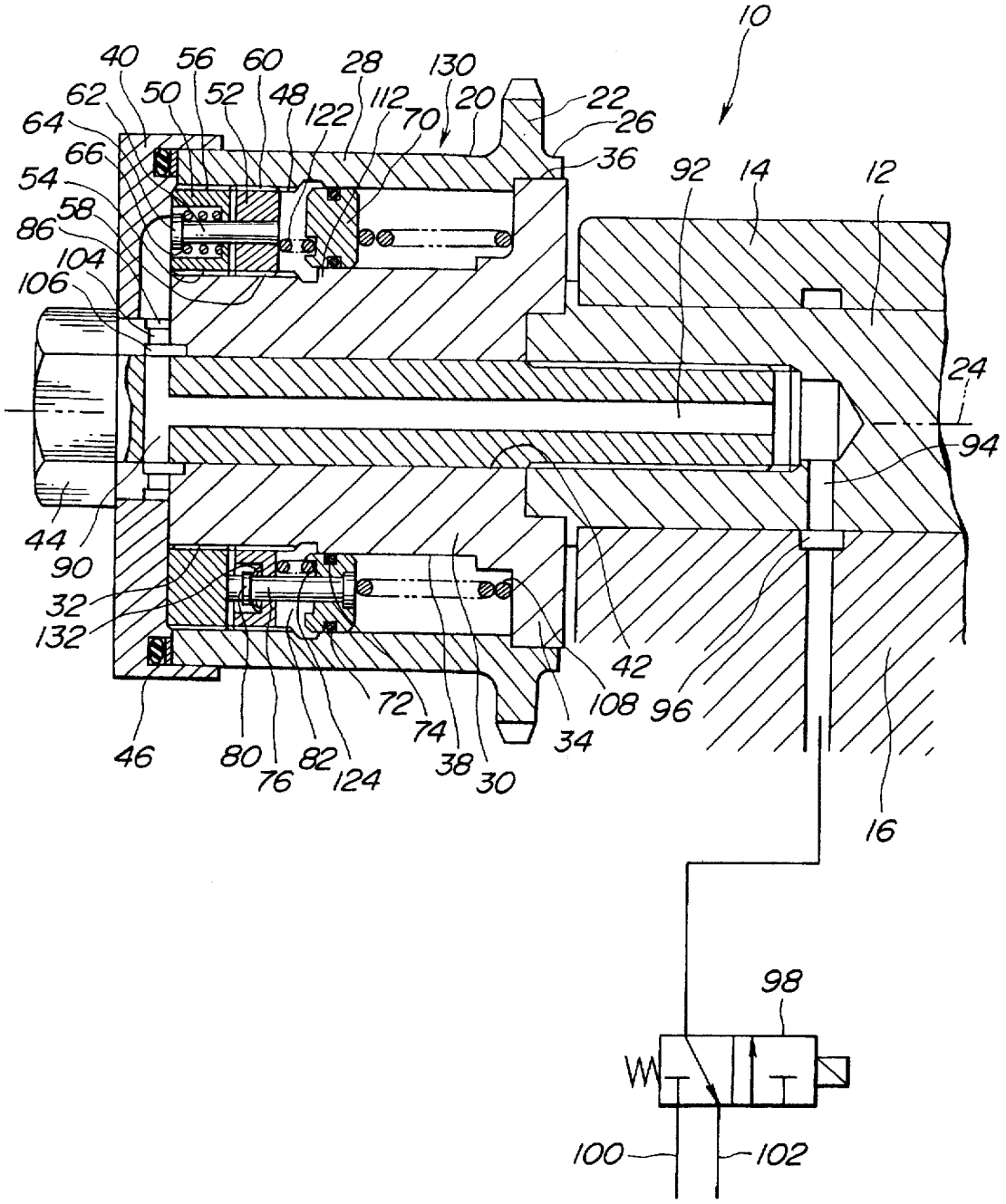
FIG. 4 is a similar view to FIG. 1, showing a third embodiment of variable camshaft phase changing device.
Figure 5:
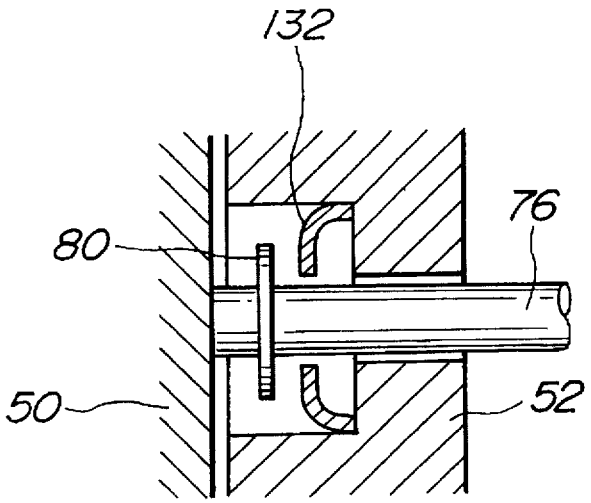
FIG. 5 is an enlarged fragmentary view of FIG. 4.
Figure 6:
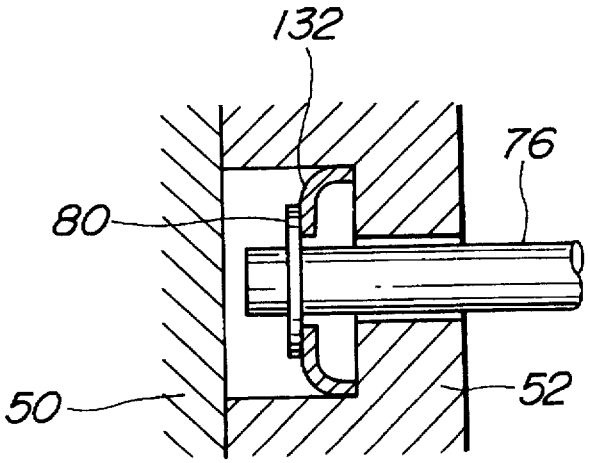
FIG. 6 is a similar view to FIG. 5, showing the position of parts when the variable camshaft phase changing device of FIG. 4 is at on condition.

FIGS. 4, 5 and 6 show a third embodiment of variable camshaft phase changing device 130. This variable camshaft phase changing device 130 is substantially the same as the second embodiment except the addition of buffer springs in the form of wave spring washers or disc springs 132 mounted within recesses 78, respectively. As best seen in FIG. 5, when the variable camshaft phase changing device 130 is at off condition, the disc spring 132 is out of contact with the snap ring 80. When the variable camshaft phase changing device 130 is during the stroke towards on condition or at the on condition, the disc spring 132 is compressed between the snap ring 80 and the rear gear 52 as shown in FIG. 6. The provision of the disc springs 132 together with a spring 122 suppresses hammering noise and wear due to repeated strike of the rear gear 52 with the snap rings 80.

If desired, the spring 122 may be eliminated. According to this modification, the disc springs 132 suppress hammering noise and wear due to repeated blow of the rear gear 52 with the snap rings 80.

Figure 7:
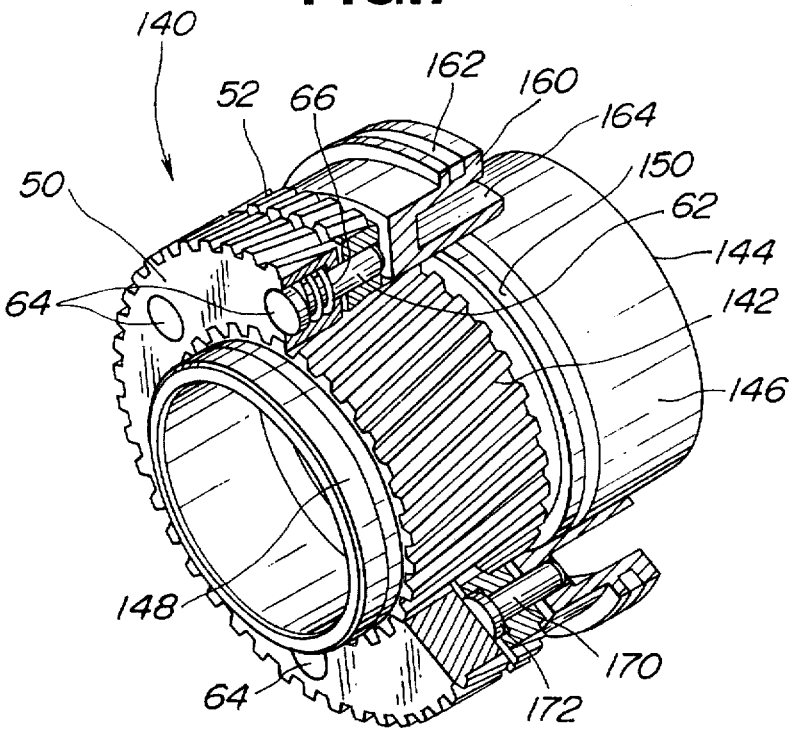
FIG. 7 is a perspective view in partial cross section of a portion of a fourth embodiment of varaible camshaft phase changing device at off condition.
Figure 8:
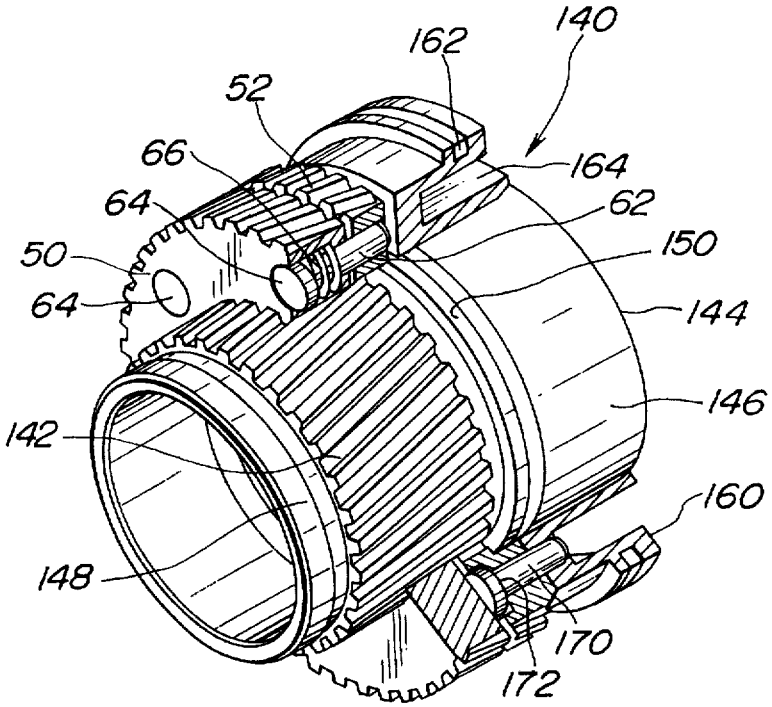
FIG. 8 is a similar view to FIG. 7, showing the variable camshaft phase changing device at on condition.

FIGS. 7 and 8 show a portion of a fourth embodiment of variable camshaft phase changing device 140. This variable camshaft phase changing device 140 is substantially the same as the previously described embodiment in the provision of two axially-spaced annular front and rear gears 50, 52. In the same manner as in the previously described embodiments, the front and rear gears 50, 52 are biased toward one another by a plurality of angularly spaced pins 62 press-fitted in the rear gear 52 and having heads 64 compressing coil springs 66 in recesses on the far side or outside face of the front gear 50. The pins 62 extend through openings of the front gear 50. The openings of the front gear 50 are wide enough to allow the front gear 50 to move angularly relative to the rear gear 52. Both gears 50, 52 have inner and outer helical splines drivingly mated with an external spline 142 of a spline shaft 144 and an internal spline of a sprocket, not shown. The sprocket is substantially the same as the sprocket 20 used in the previously described embodiment. The spline shaft 144 is substantially the same as the spline shaft 30 in that it has a finished cylindrical surface 146, an end collar 148 and an annular shoulder 150 as counterparts of the finished cylindrical surface 38, end collar 88 and annular shoulder 112 (see FIG. 1). An annular piston 160 slightly modified from the annular piston 70 is formed with an outer annular groove 162 for receiving an outer peripheral seal, not shown. The annular piston 160 is different from the annular piston 70 in the provision of a pocket 164 cut axially inwardly for receiving a return spring, not shown. The annular piston 160 is disposed adjacent the inside face of the rear gear 52 and mounted thereto by a plurality of angularly spaced pins 170. The pins 170 extend through openings of the rear gear 52 and press-fitted in the annular piston 160. The pins 170 extend forwardly through the ring gear 52 and have heads 172 for abutting against the inside face of the front gear 50. The pin heads 172 are disposed within recesses, not numbered, cut in the outside face of the rear gear 52. The pins 170 are slidably carried by the rear gear 52. The pin head 172 come into abutting engagement with the bottom of the recesses in the rear gear 52 to limit axial and rearward displacement of the annular piston 160 away from the rear gear 52.

When oil under pressure is applied to the annular piston 160, the oil pressure moves the annular piston 160 from one extreme position shown in FIG. 7 to the extreme opposite position shown in FIG. 8, pulling the rear gear 52 after engagement of the pin heads 172 with the bottoms of the recesses in the rear gear 52 and then pulling the front gear 50 that is biased towards the rear gear 52.

In the position shown in FIG. 8, the rear gear 52 is pressed against the annular shoulder 150 defined between the external helical spline 142 and cylindrical surface 146 of the spline shaft 144.

During a return to the position shown in FIG. 7, the pin heads 172 abut on the front gear 50, pushing the front gear 50 and then the rear gear 52 that is biased towards the front gear 50.

During the stroke from the position shown in FIG. 7 to the position shown in FIG. 8 and the return stroke, the separation of the front and rear gears 50, 52 from one another is slightly increased to reduce the lash take-up force, thus reducing the friction that opposes the stroke motion of the front and rear gears 50, 52. Quick motion of the front and rear gears 50, 52 for the strokes is thereby accomplished.

Preferrably, coil springs may be compressed between the annular piston 160 and rear gear 52 to bias the rear gear 52 toward the pin heads 172 as were the coil springs 110 in the previously described embodiment. Further or alternatively, disc springs may be mounted within the recesses in the rear gear 52 to mate with the pins heads 172, respectively, as were the disc springs 132 in the previously described third embodiment and its modification.

What is claimed is:

1. A variable camshaft phase changing device for an internal combustion engine having a camshaft and rotatable about a camshaft axis, comprising:

co-axial drive and driven members, said driven member being securable to the camshaft for rotation therewith about an axis;

a pair of axially-spaced annular gears disposed and engaged between said drive and driven members, said pair of axially-spaced annular gears having inner and outer splines;

means for biasing said annular gears one toward the other for lash take-up;

force means for axially moving said annular gears in one direction to vary the phase relationship between said drive and driven members, said force means including an annular piston, a chamber on one side of said annular piston and oil supplied under pressure to said chamber, said annular piston being axially movable in said one direction in response to said oil under pressure supplied to said chamber, said annular piston having a plurality of pins passing through one of said annular gears toward the other of said annular gears;

return spring means biasing said annular piston in a return direction opposite to said one direction to keep said pins in driving contact with the other of said annular gears to move said other of said annular gears in said return direction as said annular piston moves in said return direction, said pins having portions arranged to come into driving relation with said one of said annular gears for transmitting motion of said plurality of pins to said one of said annular gears to move said one of said annular gears in said one direction as said annular piston moves in said one direction.

2. A variable camshaft phase changing device as claimed in claim 1, wherein said portions of said pins are maintained in resilient relation with said one of said annular gear after said portions of said pins have come into said driving relation with said one of said annular gears.

3. A variable camshaft phase changing device as claimed in claim 2, wherein spring means is compressed between said one of said annular gears and said annular piston to bias said one of said annular gears toward the other of said annular gears.

4. A variable camshaft phase changing device as claimed in claim 2, wherein buffer springs mounted on said one of said annular gears are arranged to contact with said portions of said pins, respectively.

5. A variable camshaft phase changing device as claimed in claim 3, wherein buffer springs mounted on said one of said annular gears are arranged to contact with said portions of said pins, respectively.

6. A variable camshaft phase changing device as claimed in claim 3, wherein said spring means compressed between said one of said annular gears and said annular piston include coil springs encircling said pins, respectively.

7. A variable camshaft phase changing device as claimed in claim 3, wherein said spring means compressed between said one of said annular gears and said annular piston include a coil spring received in an annular reccess cut in said annular piston and disposed radially inwardly relative to the camshaft axis compared to said pins.

8. A variable camshaft phase changing device as claimed in claim 7, wherein buffer springs mounted on said one of said annular gears are arranged to contact with said portions of said pins, respectively.

9. A variable camshaft phase changing device as claimed in claim 3, wherein said annular gears are angularly movable relative to one another.

10. A variable camshaft phase changing device as claimed in claim 3, wherein said portions of said pins are snap rings, respectively.

11. A varaible camshaft phase changing device as claimed in claim 3, wherein said portions of said pins are heads of said pins, respectively.

* * * * *